US005774137A

United States Patent [19]

Yoshida

[11] Patent Number: 5,774,137

[45] Date of Patent: Jun. 30, 1998

[54] INK JET PRINTER

[75] Inventor: Yasunari Yoshida, Aichi-ken, Japan

[73] Assignee: Brother Kogyo Kabushiki Kaisha, Nagoya, Japan

[21] Appl. No.: 762,146

[22] Filed: Dec. 9, 1996

[30] Foreign Application Priority Data

Dec. 9, 1995 [JP] Japan ..... 7-345694

[51] Int. Cl.[6] ..... B41J 29/38

[52] U.S. Cl. ..... 347/14; 347/17; 388/934

[58] Field of Search ..... 347/17, 14.9; 237/302, 237/304, 99; 337/298, 299, 124; 388/934, 903

[56] References Cited

U.S. PATENT DOCUMENTS 5,172,142 12/1992 Watanabe et al. ..... 347/14
5,485,179 1/1996 Otsuka et al. ..... 346/140 R
5,524,993 6/1996 Durst ..... 400/279
5,576,745 11/1996 Matsubara ..... 347/14
5,581,281 12/1996 Fuse ..... 347/14

FOREIGN PATENT DOCUMENTS

A-57-47666 3/1982 Japan .
A-57-116657 7/1982 Japan .

*Primary Examiner*—Edgar S. Burr
*Assistant Examiner*—Dave A. Ghatt
*Attorney, Agent, or Firm*—Oliff & Berridge

[57] ABSTRACT

When the head driving voltage V is of the first level V1 and when the detected temperature exceeds the second threshold T2, the driving pulse voltage V is switched to the second level V2. Afterward, the driving pulse voltage V will be maintained at the second level V2 even though the ambient temperature slightly changes. When the temperature becomes lower than the threshold T1, the driving pulse voltage V is switched into the first level V1. The driving pulse voltage V will be maintained at the first level V1 even though the ambient temperature slightly changes.

17 Claims, 5 Drawing Sheets

INK JET PRINTER

BACKGROUND OF THE INVENTION

1. Field of the Invention

The present invention relates to an ink jet printer for ejecting ink onto a recording medium.

2. Description of the Related Art

The ink jet printer is provided with an ink cartridge and a recording head. The ink cartridge stores therein ink. The recording head is connected with the ink cartridge and is supplied with ink from the ink cartridge. The recording head is applied with driving pulses so as to eject ink from a plurality of ink jet nozzles onto a recording medium, thereby printing desired images on the recording medium.

The temperature of the recording head rises when the ambient temperature rises and when the recording head has been operated for a long period of time. The viscosity of the ink decreases, and the amount of ink ejected at each ejection operation increases. This degrades the clearness of an image (characters, symbols, figures, and the like) recorded on the recording medium.

To solve this problem, the conventional ink jet printer is provided with a temperature sensor for detecting the ambient temperature. A pulse height (voltage amount) or a pulse width of the driving pulses is changed in accordance with the detected temperature.

For example, Japanese Unexamined Patent Application Publication No. 57-47666 has proposed a temperature compensation device for controlling the voltage amount of the driving pulses to a minimum level. The minimum level is determined as a minimum voltage amount of a driving pulse capable of controlling the ink jet print head to eject ink. The minimum level is determined to gradually decrease in accordance with rise of the ambient temperature. Another Japanese Unexamined Patent Application Publication No. 57-116657 has proposed another temperature compensation method in which the pulse width of the driving pulses is controlled to gradually decrease in accordance with rise of the ambient temperature.

SUMMARY OF THE INVENTION

In the above-described conventional temperature compensation methods, however, the driving pulses have to be controlled in a gradually-increasing/decreasing manner. Accordingly, the control is very complicated.

The present inventor has therefore conceived to control the driving pulses in a stepwise manner. According to this method, a certain temperature threshold point Ts is determined. As shown in FIG. 1, the driving pulse voltage is controlled at a first level Vd1 when the ambient temperature is equal to or lower than the threshold point Ts. When the ambient temperature exceeds the threshold point Ts, the driving pulse voltage is controlled at a second level Vd2, which is lower than the first level Vd1 by a certain amount.

According to this method, the driving pulse voltage is switched between the first and second levels Vd1 and Vd2 in accordance with a relationship between the ambient temperature and the threshold point Ts. In this case, however, when the ambient temperature is near the threshold point Ts, the driving pulse voltage will frequently switch between the first and second levels Vd1 and Vd2 so that the recording state will greatly change during recording of an image on the recording medium. It will become impossible to uniformly record an entire image. The obtained image will have a degraded quality.

It is therefore, an object of the present invention to overcome the above-described drawbacks, and to provide an improved ink jet printer wherein driving energy for driving the ink jet print head is switched in accordance with the ambient temperature while preventing the driving energy from being frequently switched.

In order to attain these and other objects, the present invention provides an ink jet printer for ejecting ink onto a recording medium, the ink jet printer comprising: a recording head capable of ejecting ink onto a recording medium; driving energy supplying means for supplying driving energy to the recording head so as to control the recording head to eject ink; temperature detection means for detecting data indicative of temperature of the recording head; driving energy switching means for switching the driving energy in a predetermined plurality of different levels; and switching control means for receiving the detected data and for controlling the driving energy switching means based on a pair of threshold points determined for every two adjacent levels, the pair of threshold points including a first threshold point and a second threshold point, the first threshold point being determined for switching the driving energy from a lower level toward a higher level of the corresponding two adjacent levels, the second threshold point being determined for switching the driving energy from the higher level toward the lower level. The second threshold point may be higher than the first threshold point by a predetermined amount of temperature.

The switching control means may be capable of maintaining the driving energy at either one of the every two adjacent levels while the detected temperature data indicates temperature in a range defined between the corresponding pair of threshold points. The switching control means may maintain the driving energy at the higher level in the every two adjacent levels when the detected temperature data increases from below the first threshold point into the range between the first and second threshold points. The switching control means may maintain the driving energy at the lower level in the every two adjacent levels when the detected temperature data decreases from above the second threshold point into the range between the first and second threshold points.

According to another aspect, the present invention provides an ink jet printer for ejecting ink onto a recording medium, the ink jet printer comprising: a recording head capable of ejecting ink onto a recording medium; driving energy supplying means for supplying driving energy to the recording head, thereby controlling the recording head to eject ink; temperature detection means for detecting data indicative of temperature of the recording head; driving energy switching means for switching the driving energy, to be supplied to the recording head, between a predetermined first level and a predetermined second level which is lower than the first level by a predetermined amount of value; and switching control means for receiving the detected data and for controlling the driving energy switching means based on a first threshold point predetermined for switching the driving energy from the second level into the first level and a second threshold point predetermined for switching the driving energy from the first level into the second level. The second threshold point may be higher than the first threshold point by a predetermined amount of temperature.

The switching control means may include: driving energy judging means for judging whether the driving energy presently applied to the recording head has either one of the first and second levels; temperature judging means for judging whether the detected data is equal to or lower than the second threshold point when the present driving energy is equal to the first level and for judging whether the detected data is equal to or higher than the first threshold point when the present driving energy is equal to the second level; and switching determination means for determining to switch the driving energy from the present first level into the second level when the detected data is higher than the second threshold point and for determining to switch the driving energy from the present second level into the first level when the detected data is lower than the first threshold point.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENT

Figure 1:
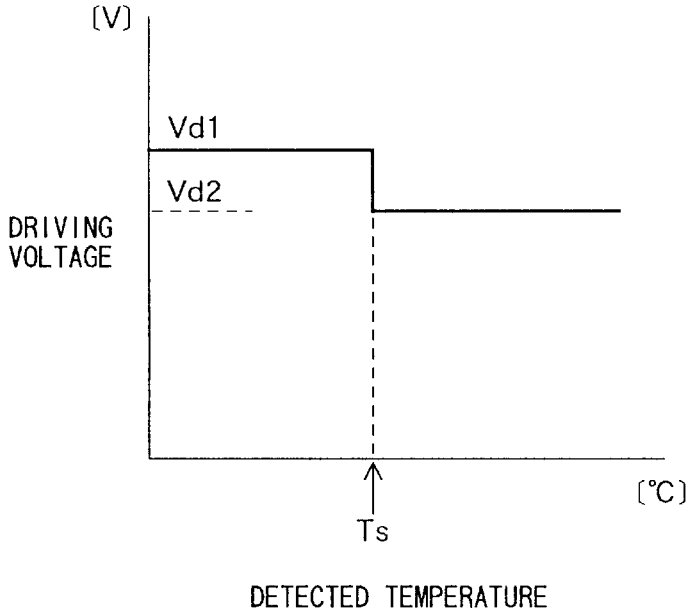
FIG. 1 shows how an ink jet print head driving voltage is switched in accordance with a conceivable switching method.

An ink jet printer according to a preferred embodiment of the present invention will be described while referring to the accompanying drawings wherein like parts and components are designated by the same reference numerals to avoid duplicating description.

Figure 2:
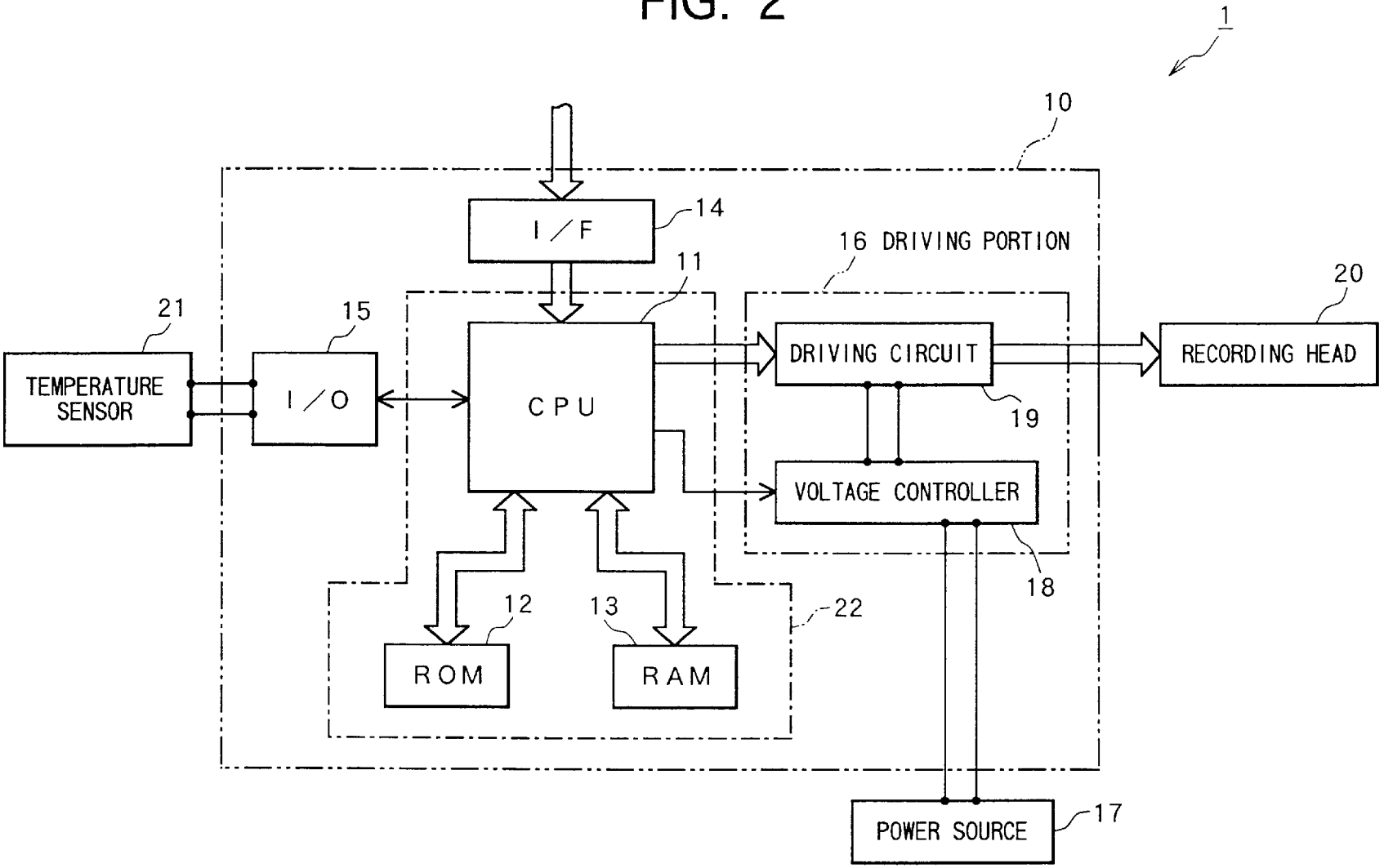
FIG. 2 is a block diagram of an essential part of a control system of an ink jet printer according to an embodiment of the present invention.

The ink jet printer 1 of the present embodiment is shown in FIG. 2. The ink jet printer 1 is for printing monochromatic images with black ink. The ink jet printer 1 includes a recording head 20 for ejecting ink onto a recording medium. The recording head 20 is mounted on a carriage (not shown). An ink cartridge (also not shown) is also mounted on the carriage so that the recording head 20 is connected with the ink cartridge. The carriage transports the recording head 20 and the ink cartridge relative to the recording medium. The ink cartridge stores therein black ink. The recording head 20 is formed with a plurality of (64, for example) ink jet nozzles for ejecting inks, supplied from the ink cartridge, onto the recording medium.

The recording head 20 is connected to a control device 10. The ink jet recording head 20 is controlled by the control device 10 to record desired images on the recording medium. The control device 10 includes: a microcomputer 22; an input interface 14; an input/output interface 15; and a driving portion 16. The microcomputer 22 includes a CPU 11, a ROM 12, and a RAM 13.

The input interface 14 is for receiving record data from an external host computer (not shown) and transferring the record data to the CPU 11. The input/output interface 15 is electrically connected with a temperature sensor 21. The driving portion 16 is connected with the recording head 20.

The ROM 12 previously stores therein a control program for switchingly controlling a driving pulse voltage for the recording head 20. The ROM 12 also stores therein two predetermined temperature threshold points, i.e., a first temperature threshold point T1 and a second temperature threshold point T2. The first threshold point T1 is lower than the second threshold point T2 by a predetermined amount of temperature. For example, the first temperature threshold point T1 is 20° C., and the second temperature threshold point T2 is 30° C. These threshold points T1 and T2 are fixed values which are determined dependent on the ink property and the structure of the recording head 20.

The RAM 13 is formed with several memories for storing several data required for achieving the control.

The temperature sensor 21 is for detecting an ambient temperature of the recording head 20. That is, the temperature sensor 21 detects temperature of an ambient atmosphere of the recording head 20. The temperature sensor 21 is of a thermistor type, for example. Although not shown in the drawing, the input/output interface 15 includes: a driver for driving the temperature sensor 21; and an A/D converter for converting analog detection signals supplied from the temperature sensor 21 into digital temperature detection data. The input/output interface 15 supplies the digital temperature detection data to the CPU 11.

The CPU 11 performs entire control of the printer 1. Upon receiving the record data from the input interface 14, the CPU 11 produces record control signals and supplies the record control signals to the driving portion 16. The record control signals will control the driving portion 16 to drive the recording head 20 to record images represented by the record data. As will be described later, the CPU 11 also performs a driving voltage switching control operation onto the voltage amount (pulse height) of the driving pulses in accordance with the digital temperature detection data. That is, the CPU 11 produces first and second level instruction signals based on the digital temperature detection data supplied from the temperature sensor 21. The CPU 11 controls the amounts of the driving pulse voltages in accordance with the first and second level instruction signals.

The driving portion 16 is for selectively supplying the recording head 20 with driving pulses to thereby control the recording head to eject ink onto the recording medium. The driving portion 16 includes a voltage control circuit 18 and a driving circuit 19. The voltage control circuit 18 is electrically connected with a power supply 17. Supplied with electric power from the power supply 17, the voltage control circuit 18 is capable of generating voltages of predetermined first and second levels V1 and V2. The first level V1 is 30 volts, for example. The second level V2 is lower than the first level V1 by a predetermined voltage (five volts, for example). The voltage control circuit 18 is controlled by the CPU 11 during the driving voltage switching control operation. That is, when the CPU 11 supplies a first level instruction signal to the voltage control circuit 18, the voltage control circuit 18 generates a voltage of the first level V1. When the CPU 11 supplies a second level instruction signal to the voltage control circuit 18, the voltage control circuit 18 generates a voltage of the second level V2.

The driving circuit 19 is for receiving both the record control signals supplied from the CPU 11 and the voltage supplied from the voltage control circuit 18. The driving circuit 19 produces driving pulses in accordance with the record control signals so that the driving pulses have voltage amounts supplied from the voltage control circuit 18. The driving circuit 19 supplies the driving pulses to the recording head 20 so as to actuate the recording head 20 to eject ink onto the recording medium.

Figure 3:
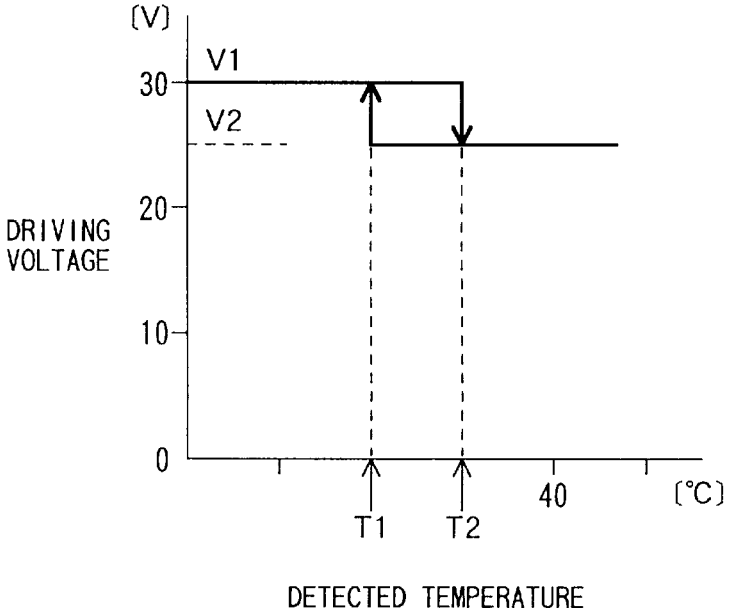
FIG. 3 shows how an ink jet print head driving voltage is switched according to a driving voltage switching control operation employed in the embodiment.

According to the present invention, the CPU 11 performs the driving voltage switching control operation in accordance with the driving voltage control program stored in the ROM 12. As shown in FIG. 3, according to this control operation, the driving pulse voltage is switched between the first level V1 and the second level V2. The driving pulse voltage is switched from the second level V2 to the first level V1 in accordance with a relationship between the ambient temperature and the first threshold point T1. The driving pulse voltage is switched from the first level V1 back to the second level V2 according to a relationship between the ambient temperature and the second threshold point T2.

Figure 4:
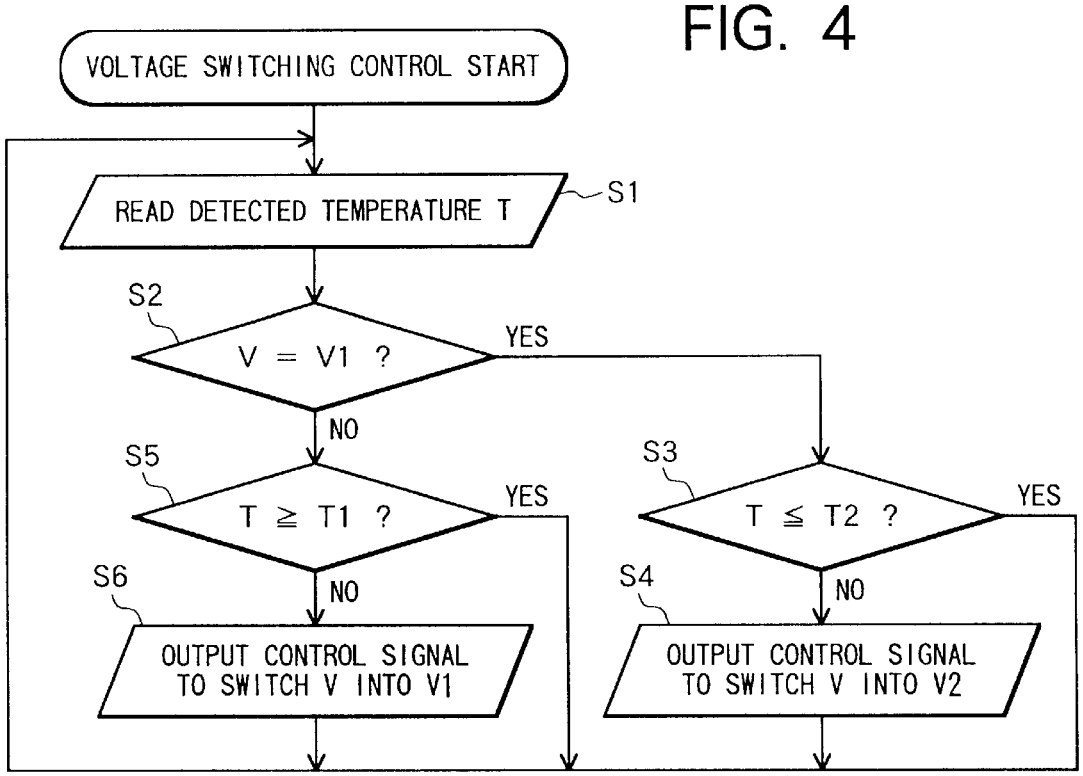
FIG. 4 is a flowchart of the driving voltage switching control operation.

The driving voltage switching control operation will be described below in greater detail with reference to FIG. 4. The CPU 11 continuously performs the driving voltage switching control whenever the printer is performing a printing operation.

That is, when the CPU 11 controls the recording head 20 to start printing, the CPU 11 starts the driving pulse voltage switching control. First, in S1, the CPU 11 receives the temperature detection data T from the temperature sensor 21. Then, in S2, the CPU 11 judges whether or not a driving pulse voltage V, presently applied to the print head 20 from the driving circuit 19, is equal to the first level V1. When V is equal to V1 (yes in S2), the CPU 11 further judges in S3 whether or not the temperature detection data T is equal to or lower than the second threshold point T2 (i.e., $T \leqq T2$). When $T \leqq T2$ (yes in S3), it is unnecessary to switch the driving pulse voltage V to the second level V2. Accordingly, the program returns to S1. On the other hand, when $T > T2$ (no in S3), the CPU 11 outputs in S4 the second level instruction signal to the voltage control circuit 18 so as to switch the voltage V into the second level V2. As a result, the voltage control circuit 18 supplies the voltage of the second level V2 to the driving circuit 19. The driving circuit 19 therefore produces driving pulses of the second level V2. Then, the program returns to S1.

On the other hand, when the present driving pulse voltage V is not equal to V1 but is equal to V2 (no in S2), the CPU 11 further judges in S5 whether or not the temperature detection data T is equal to or higher than the first threshold point T1 (i.e., $T \geqq T1$). When $T \geqq T1$ (yes in S5), it is unnecessary to switch the driving pulse voltage V to the first level V1. Accordingly, the program returns to S1. On the other hand, when $T < T1$ (no in S5), the CPU 11 outputs in S6 the first level instruction signal to the voltage control circuit 18 so as to switch the voltage V into the first level V1. As a result, the voltage control circuit 18 supplies the voltage of the first level V1 to the driving circuit 19. The driving circuit 19 therefore produces driving pulses of the first level V1. Then, the program returns to S1.

As described above, when the head driving voltage V is of the first level V1 and when the detected temperature exceeds the second threshold T2, the driving pulse voltage V is switched to the second level V2. Afterward, the driving pulse voltage V will be maintained at the second level V2 even though the ambient temperature slightly changes. The driving pulse voltage V will be maintained at the second level V2 until the temperature T decrease to be lower than the threshold T1, which is sufficiently lower than the threshold T2. When the temperature becomes lower than the threshold T1, the driving pulse voltage V is switched into the first level V1. The driving pulse voltage V will be maintained at the first level V1 even though the ambient temperature slightly changes. The driving pulse voltage V will be maintained at the first level V1 until the temperature T increases to exceed the threshold T2 which is sufficiently higher than the threshold T1.

Thus, according to the present embodiment, when the temperature T is lower than the threshold T1, the driving pulse voltage V is controlled at the first level V1. When the temperature T is higher than the threshold T2, the driving pulse voltage V is controlled at the second level V2. When the temperature T is between the thresholds T1 and T2, on the other hand, the driving pulse voltage V is controlled at either the first level V1 or the second level V2. That is, when the temperature increases from below the threshold T1 into the range between the thresholds T1 and T2, the driving pulse voltage V is maintained at the first level V1. When the temperature decreases from above the threshold T2 into the range between the thresholds T1 and T2, the driving pulse voltage V is maintained at the second level V2.

It is noted that the second threshold T2 is set as a temperature higher than the first threshold T1 by the sufficiently large amount of temperature (10° C. in this example). Because the ambient temperature does not change rapidly but changes gradually, the driving pulse voltage will not be switched until a certain length of time passes after the voltage is switched. It is therefore possible to reliably prevent the voltage V being frequently switched between the first and second levels.

There is little possibility that the voltage is switched while the recording head 20 is recording a single image (text or figure). The entire image can be recorded uniformly.

Figure 5:
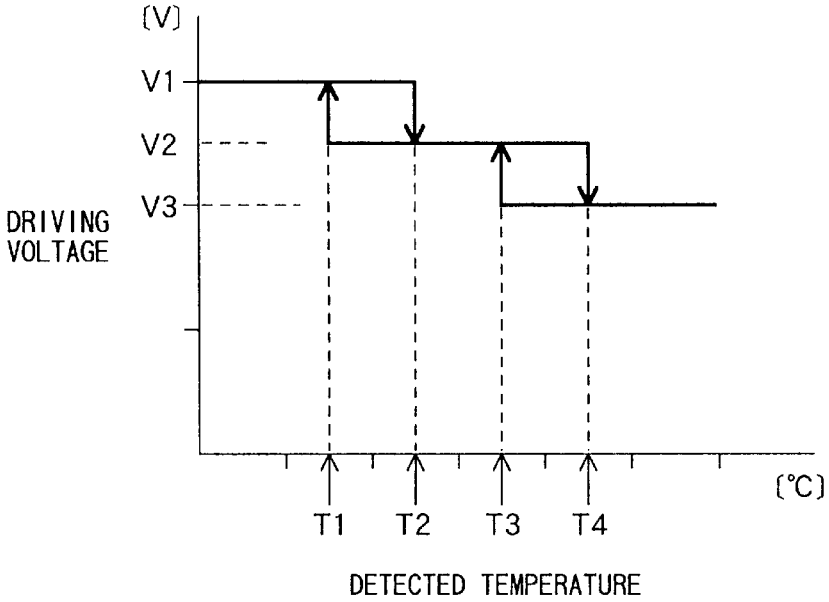
FIG. 5 shows how an ink jet print head driving voltage is switched according to a modification.

In the above-described embodiment, the driving pulse voltage V is switched between two levels, i.e., the first level V1 and the second level V2 in accordance with a relationship between the temperature and the two temperature threshold points T1 and T2. However, as shown in FIG. 5, the driving pulse voltage V may be switched between three levels V1, V2, and V3 in accordance with a relationship between the temperature and four temperature threshold points T1, T2, T3, and T4. For example, the values T1, T2, T3, and T4 may be set to 18° C., 22° C., 28° C., and 32° C., respectively. The values V1, V2, and V3 may be set to 30 volts, 26 volts, and 22 volts, respectively.

The threshold point T1 is for determining whether the driving pulse voltage V should be switched from the second level V2 into the first level V1. The threshold point T2 is for determining whether the driving pulse voltage V should be switched from the first level V1 into the second level V2. The threshold point T3 is for determining whether the driving pulse voltage V should be switched from the third level V3 into the second level V2. The threshold point T4 is for determining whether the driving pulse voltage V should be switched from the second level V2 into the third level V3.

In other words, a pair of threshold points T1 and T2 are determined for the pair of adjacent levels V1 and V2. The threshold point T1 is determined for switching the driving pulse voltage from the lower level V2 toward the higher level V1. The threshold point T2 is determined for switching the driving pulse voltage from the higher level V1 toward the lower level V2. Similarly, another pair of threshold points T3 and T4 are determined for the other pair of adjacent levels V2 and V3. The threshold point T3 is determined for switching the driving pulse voltage from the lower level V3 toward the higher level V2. The threshold point T4 is determined for switching the driving pulse voltage from the higher level V2 toward the lower level V3.

Thus, when the temperature T is lower than the threshold T1, the driving pulse voltage V is controlled at the first level V1. When the temperature T is higher than the threshold T4, the driving pulse voltage V is controlled at the third level V3. When the temperature T is between the thresholds T2 and T3, the driving pulse voltage V is controlled at the second level V2. When the temperature T is between the thresholds T1 and T2, on the other hand, the driving pulse voltage V is controlled at either one of the first and second levels V1 and V2. That is, when the temperature increases from below the threshold T1 into the range between the thresholds T1 and T2, the driving pulse voltage V is maintained at the first level V1. When the temperature decreases from above the threshold T2 into the range between the thresholds T1 and T2, the driving pulse voltage V is maintained at the second level V2. Similarly, when the temperature T is between the thresholds T3 and T4, the driving pulse voltage V is controlled at either one of the second and third levels V2 and V3. That is, when the temperature increases from below the threshold T3 into the range between the thresholds T3 and T4, the driving pulse voltage V is maintained at the second level V2. When the temperature decreases from above the threshold T4 into the range between the thresholds T3 and T4, the driving pulse voltage V is maintained at the third level V3.

Thus, the driving pulse voltage V may be switched between the plurality of levels in accordance with a relationship between the temperature and the plurality of temperature threshold points. It is still possible to prevent the driving pulse voltage V from being switched frequently.

In the above description, the driving pulse voltage is controlled into three levels. However, the driving pulse voltage can be controlled at other various numbers of levels. Also in these cases, a pair of threshold points may be determined for every two adjacent levels. The pair of threshold points includes: a lower threshold point determined for switching the driving pulse voltage from a lower level toward a higher level of the two adjacent levels; and a higher threshold point determined for switching the driving pulse voltage from the higher level toward the lower level. The driving pulse voltage is maintained at either one of the every two adjacent levels while the temperature is the range between the pair of threshold points. Accordingly, the driving pulse voltage will be maintained at the higher level when the temperature increases from below the lower threshold point into the range between the pair of threshold points, and the driving pulse voltage will be maintained at the lower level when the temperature decreases from above the higher threshold point into the range between the pair of threshold points. The driving pulse voltage will not be frequently switched.

Another modification of the present embodiment will be described below.

Figure 6:
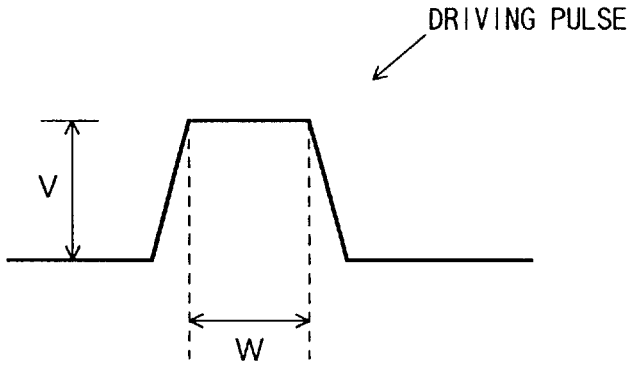
FIG. 6 shows a driving pulse applied to a recording head.

In the above-described embodiment, a voltage amount (pulse height) V of each driving pulse, applied to the recording head 20 as shown in FIG. 6, is controlled. However, a pulse width W of each driving pulse can be controlled in the same manner as in the above-described embodiment. In this case, the voltage control circuit 18 is modified so that the circuit 18 outputs a fixed amount of voltage and so that the circuit 18 controls the driving circuit 19 to change a pulse width W of each driving pulse before outputting the driving pulse to the recording head 20.

Figure 7:
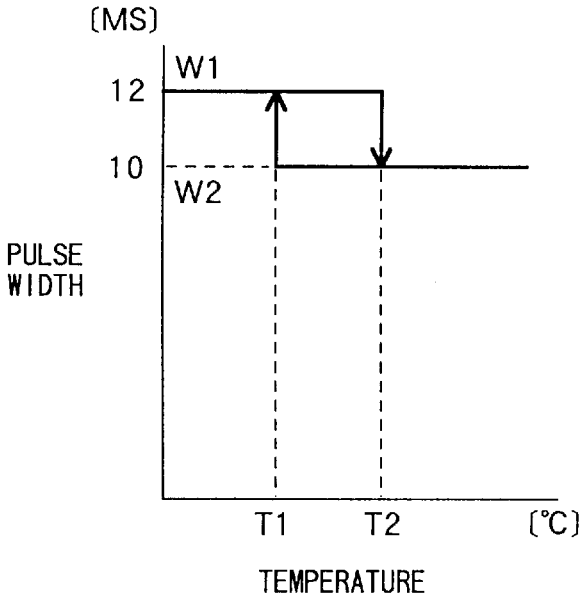
FIG. 7 shows how an ink jet print head driving pulse width is switched through a driving pulse width switching control operation according to another modification.

As shown in FIG. 7, according to this modification, the driving pulse width is switched between a first level W1 (12 $\mu$S, for example) and a second level W2 (10 $\mu$S, for example). The driving pulse width is switched from the second level W2 to the first level W1 in accordance with a relationship between the ambient temperature and the first threshold point T1. The driving pulse width is switched from the first level W1 back to the second level W2 according to a relationship between the ambient temperature and the second threshold point T2.

Figure 8:
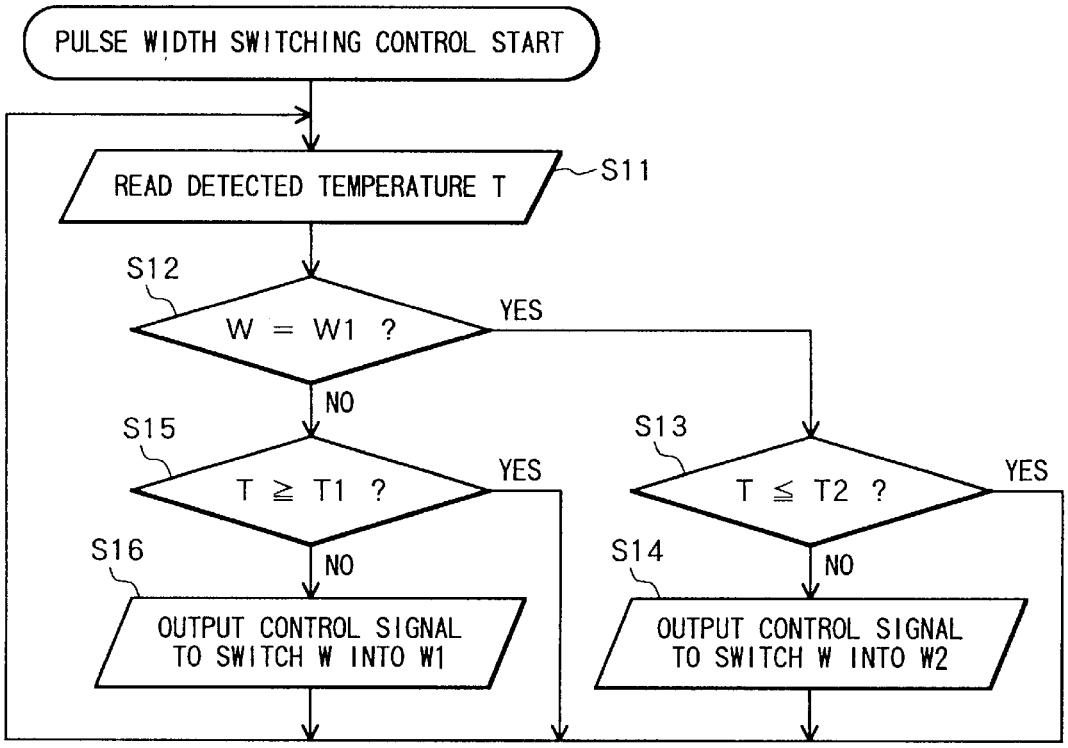
FIG. 8 is a flowchart of the driving pulse width switching control operation.

The pulse width switching control operation will be described below in greater detail with reference to FIG. 8. The CPU 11 continuously performs the driving pulse width switching control whenever the printer is performing a printing operation.

That is, when the CPU 11 controls the recording head 20 to start printing, the CPU 11 starts the driving pulse width switching control. First, in S11, the CPU 11 receives the temperature detection data T from the temperature sensor 21. Then, in S12, the CPU 11 judges whether or not pulse width W of a driving pulse, presently applied to the print head 20 from the driving circuit 19, is equal to the first level W1. When W is equal to W1 (yes in S12), the CPU 11 further judges in S13 whether or not the temperature detection data T is equal to or lower than the second threshold point T2 (i.e., $T \leqq T2$). When $T \leqq T2$ (yes in S13), it is unnecessary to switch the driving pulse width W to the second level W2. Accordingly, the program returns to S11. On the other hand, when $T > T2$ (no in S13), the CPU 11 outputs in S14 a second level instruction signal to the voltage control circuit 18. Upon receiving the second level instruction signal, the voltage control circuit 18 controls the driving circuit 19 to produce driving pulses with pulse width of the second level W2. Then, the program returns to S11.

On the other hand, when the present driving pulse width W is not equal to W1 but is equal to W2 (no in S12), the CPU 11 further judges in S15 whether or not the temperature detection data T is equal to or higher than the first threshold point T1 (i.e., $T \geqq T1$). When $T \geqq T1$ (yes in S15), it is unnecessary to switch the driving pulse width W to the first level W1. Accordingly, the program returns to S11. On the other hand, when $T < T1$ (no in S15), the CPU 11 outputs in S16 a first level instruction signal to the voltage control circuit 18. Upon receipt of the first level instruction signal, the voltage control circuit 18 controls the driving circuit 19 to produce driving pulses with pulse width of the first level W1. Then, the program returns to S11.

As described above, when the head driving pulse width W is of the first level W1 and when the detected temperature exceeds the second threshold T2, the driving pulse width W is switched to the second level W2. Afterward, the driving pulse width W will be maintained at the second level W2 even though the ambient temperature slightly changes. The driving pulse width W will be maintained at the second level W2 until the temperature T decrease to be lower than the threshold T1, which is sufficiently lower than the threshold T2. When the temperature becomes lower than the threshold T1, the driving pulse width W is switched into the first level W1. The driving pulse width W will be maintained at the first level W1 even though the ambient temperature slightly changes. The driving pulse width W will be maintained at the first level W1 until the temperature T increases to exceed the threshold T2 which is sufficiently higher than the threshold T1.

It is noted that in the same manner as described above, the ink jet printer 1 may be designed to control other various parameters of driving energy applied to the recording head.

While the invention has been described in detail with reference to the specific embodiment thereof, it would be apparent to those skilled in the art that various changes and modifications may be made therein without departing from the spirit of the invention.

In the above-described embodiment, temperature of the ambient atmosphere of the recording head 20 is detected by the temperature sensor 21. The detected temperature indicates the temperature of the recording head 20. However, the temperature of the recording head 20 may be directly detected.

The above-described embodiment is directed to a monochromatic color printer. However, the present invention can be applied to a full color printer which can eject ink of a plurality of colors such as three or four colors.

What is claimed is:

1. An ink jet printer for ejecting ink onto a recording medium, the inkjet printer comprising:

a recording head capable of ejecting ink onto a recording medium;

driving energy supplying means for supplying driving energy to the recording head so as to control the recording head to eject ink;

temperature detection means for detecting data indicative of temperature of the recording head;

driving energy switching means for switching the driving energy in a predetermined plurality of different levels; and switching control means for receiving the detected data and for controlling the driving energy switching means based on a pair of threshold points determined for every two adjacent levels of the plurality of different levels, the pair of threshold points including a first threshold point and a second threshold point, the first threshold point being determined for switching the driving energy from a lower level toward a higher level of the corresponding two adjacent levels, the second threshold point being determined for switching the driving energy from the higher level toward the lower level.

2. An ink jet printer as claimed in claim 1, wherein the second threshold point is higher than the first threshold point by a predetermined amount of temperature.

3. An ink jet printer as claimed in claim 1, wherein the switching control means is capable of maintaining the driving energy at either one of the every two adjacent levels while the detected temperature data indicates temperature in a range defined between the corresponding pair of threshold points.

4. An ink jet printer as claimed in claim 3, wherein the switching control means maintains the driving energy at the higher level in the every two adjacent levels when the detected temperature data increases from below the first threshold point into the range between the first and second threshold points, and the switching control means maintains the driving energy at the lower level in the every two adjacent levels when the detected temperature data decreases from above the second threshold point into the range between the first and second threshold points.

5. An ink jet printer as claimed in claim 4, wherein the driving energy switching means switches a voltage amount of a driving pulse applied to the recording head.

6. An ink jet printer as claimed in claim 4, wherein the driving energy switching means switches a pulse width of a driving pulse applied to the recording head.

7. An ink jet printer as claimed in claim 4, wherein the temperature detection means detects temperature of the recording head.

8. An ink jet printer as claimed in claim 4, wherein the temperature detection means detects temperature of an ambient atmosphere of the recording head.

9. An ink jet printer for ejecting ink onto a recording medium, the ink jet printer comprising:

a recording head capable of ejecting ink onto a recording medium;

driving energy supplying means for supplying driving energy to the recording head, thereby controlling the recording head to eject ink;

temperature detection means for detecting data indicative of temperature of the recording head;

driving energy switching means for switching the driving energy, to be supplied to the recording head, between a predetermined first level and a predetermined second level which is lower than the first level by a predetermined amount of value; and switching control means for receiving the detected data and for controlling the driving energy switching means based on a first threshold point predetermined for switching the driving energy from the second level into the first level and a second threshold point predetermined for switching the driving energy from the first level into the second level.

10. An ink jet printer as claimed in claim 9, wherein the second threshold point is higher than the first threshold point by a predetermined amount of temperature.

11. An ink jet printer as claimed in claim 9, wherein the switching control means includes:

driving energy judging means for judging whether the driving energy presently applied to the recording head has either one of the first and second levels;

temperature judging means for judging whether the detected data is equal to or lower than the second threshold point when the present driving energy is equal to the first level and for judging whether the detected data is equal to or higher than the first threshold point when the present driving energy is equal to the second level; and switching determination means for determining to switch the driving energy from the present first level into the second level when the detected data is higher than the second threshold point and for determining to switch the driving energy from the present second level into the first level when the detected data is lower than the first threshold point.

12. An ink jet printer as claimed in claim 9, wherein the switching control means maintains the driving energy at the first level while the detected temperature data is lower than the first threshold point, the switching control means maintains the driving energy at the second level while the detected temperature data is higher than the first threshold point, and the switching control means is capable of maintaining the driving energy at either one of the first and second levels while the detected temperature data is in a range defined between the first and second threshold points.

13. An ink jet printer as claimed in claim 12, wherein the switching control means maintains the driving energy at the first level when the detected temperature data increases from below the first threshold point into the range between the first and second threshold points, and the switching control means maintains the driving energy at the second level when the detected temperature data decreases from above the second threshold point into the range between the first and second threshold points.

14. An ink jet printer as claimed in claim 9, wherein the driving energy switching means switches a voltage amount of a driving pulse applied to the recording head.

15. An ink jet printer as claimed in claim 9, wherein the driving energy switching means switches a pulse width of a driving pulse applied to the recording head.

16. An ink jet printer as claimed in claim 9, wherein the temperature detection means detects temperature of the recording head.

17. An ink jet printer as claimed in claim 9, wherein the temperature detection means detects temperature of an ambient atmosphere of the recording head.

* * * * *